United States Patent [19]

Simms, Sr.

[11] Patent Number: 4,930,599

[45] Date of Patent: Jun. 5, 1990

[54] LADDER AND CARRIAGE COMBINATION

[76] Inventor: Ernest L. Simms, Sr., Route 60, Hines, W. Va. 25967

[21] Appl. No.: 394,798

[22] Filed: Aug. 17, 1989

[51] Int. Cl.[5] ..... E06C 7/12; E06C 7/48

[52] U.S. Cl. ..... 182/103; 187/10

[58] Field of Search ..... 182/103, 102, 101, 142; 187/10

[56] References Cited

U.S. PATENT DOCUMENTS

| | | | |
|---|---|---|---|
| 593,392 | 11/1897 | Fitch | 187/10 |
| 1,183,960 | 5/1916 | Ecker et al. | 182/103 |
| 2,588,959 | 3/1952 | Campbell | 182/103 |
| 2,660,263 | 11/1953 | Raddatz | 187/10 |
| 2,714,434 | 8/1955 | Peterson | 187/10 |
| 3,115,211 | 12/1963 | Ostnander, Jr. | 182/103 |
| 3,666,054 | 5/1972 | Ellings et al. | 187/10 |
| 4,183,423 | 1/1980 | Lewis | 182/103 |
| 4,546,853 | 10/1985 | Hanson | 182/103 |
| 4,546,854 | 10/1985 | Bocker | 182/103 |

FOREIGN PATENT DOCUMENTS

| | | | |
|---|---|---|---|
| 1477878 | 4/1966 | France | 182/103 |

*Primary Examiner*—Reinaldo P. Machado

*Attorney, Agent, or Firm*—Henderson & Sturm

[57] ABSTRACT

A combination ladder and carriage carried by the ladder for up and down movement to carry loads up the ladder at construction sites including building, repairs and the like at elevated heights. The upper ends of the ladder rails are extended in bow-like fashion so as to enable the ladder to reach over a roof or other elevated structure, and the carriage has a back wall of flexible construction enabling it to accommodate the bow-like ends of the ladder whereby to bring the load more closely to where it is needed.

3 Claims, 1 Drawing Sheet

LADDER AND CARRIAGE COMBINATION

BACKGROUND AND SUMMARY OF THE INVENTION

Many ladder and carriage combinations exist in the prior art but so far as is known, none involves the bow-like upper ends of the ladder and the ability of the carriage to conform to those ends whereby to bring the platform load in closer proximity to the site where needed. Accordingly, the principal object of the invention is to provide such ladder and accompanying load-carrying carriage. Another feature of the invention is that the carriage is of L-shaped form including a generally horizontal platform and a back fastened to and rising from the platform. The back is capable of flexing about a horizontal axis so as to conform to the bow-shaped upper end of the ladder. A still further feature is the provision of a power package that may be easily carried from one job to another for use in moving the carriage up and down. In this area, the package includes a bottom adapted to rest on the ground beneath the ladder and the bottom of the ladder rests on the bottom and supports power means for operating cable and sheave means, for example, for raising and lowering the carriage.

The foregoing and other features and objects will appear as the disclosure progresses.

DETAILED DESCRIPTION OF A PREFERRED EMBODIMENT OF THE INVENTION

Figure 4:
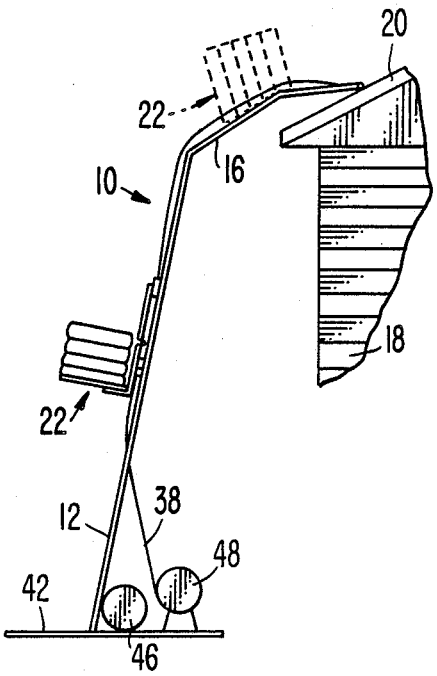
FIG. 4 is a small-scale elevation showing the ladder in use with respect to a building.

The ladder per se is designated by the numeral 10 and includes a pair of parallel rails 12 cross-connected by horizontal rungs 14. The ladder has generally the appearance of a conventional ladder except for the feature of having upper end portions or rail extensions 16 configured in bow-like fashion. As seen in FIG. 4, this enables the ladder to operate in stand-off relation to a building 18 and also to enable the upper extensions 16 to reach over a roof 20 or equivalent structure. The ladder may be of any suitable high-strength, light-weight material and may be formed of readily connectible and disconnectible sections for convenience in shipping and transport.

Figure 5:
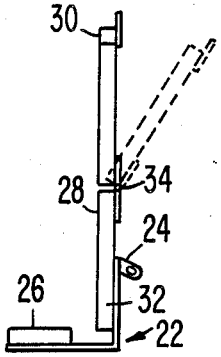
FIG. 5 is a fragmentary view showing the construction of the back part of the carriage.

A load-carrying carriage 22 is carried by the ladder for up and down movement, as by suitable rollers 24 (FIG. 5). The carriage is of L-shaped form, having a bottom or platform 26 and an upright back 28. The back comprises upper and lower portions 30 and 32 hinged together on a horizontal axis by any appropriate means such as a pair of hinges 34, the upper part being thus capable of bending or flexing as seen by the dotted lines in FIGS. 4 and 5. The lower part is rigidly attached to the platform. The purpose of the flexibility between the parts 30 and 32 is to enable the carriage back to flex and thus to conform to the bowed upper ends of the ladder and thus to permit the carriage to more closely approach the localized construction site (FIG. 4). That is, if the ladder were straight, the carriage could not turn the corner. The advantage is seen in the dotted lines in FIG. 4 when it is considered that the load is more readily accessible to workmen on the roof, since the workman is able to unload the carriage because the carriage back is substantially horizontal. It is also contemplated that the extensions 16 could be further extended to further facilitate the work.

Figure 1:
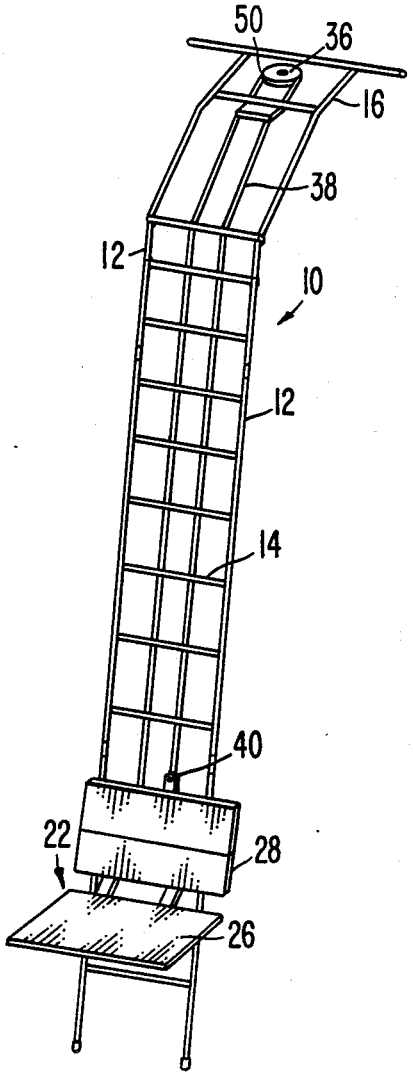
FIG. 1 is a perspective showing the ladder in its upright mode.
Figure 2:
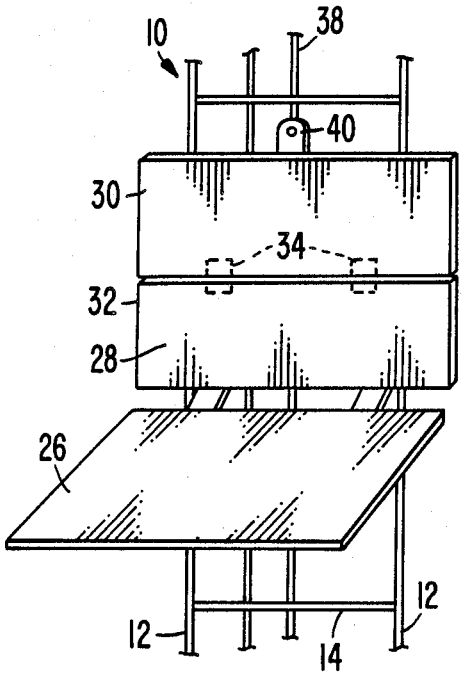
FIG. 2 is an enlarged fragmentary perspective better illustrating the load carriage.
Figure 3:
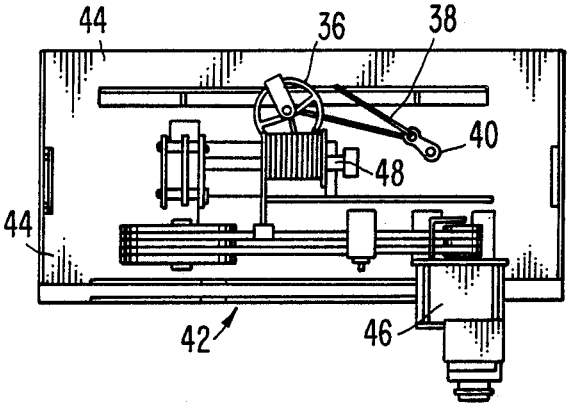
FIG. 3 is a plan of the power package.

The carriage is raised and lowered by means including a sheave 36 and cable 38, the latter being connected at one end at 40 to the top part of the carriage, thus applying force at a point where the carriage back is compelled to follow the upper end of the ladder. Another part of the means includes a package 42 (FIGS. 3 and 4) which contains a floor or bottom 44 of steel or the like on which is supported power means such as an electric motor 46 and motor-driven winch 48 on which the other end of the cable 38 is wound. The motor may be reversible and the pulleys may be of any suitable type. In use, the bottom 44 rests on the ground and the bottom of the ladder rests on the bottom so that forces exerted during raising and lowering of the carriage are properly applied. As seen in FIG. 1, the sheave in use is connected to the upper area of the ladder at 50. During transport of the combination from one job to another, the ladder is disassembled into short components, the sheave and cable are disconnected from the ladder and carriage and stacked on the floor 44. At the next site, the arrangement is easily set up for use.

Features and advantages other than those pointed out will become apparent to those versed in the art, as will many modifications in the preferred embodiment disclosed, all without departure from the spirit and scope of the invention.

I claim:

1. In combination, a ladder having a pair of parallel, upright rails and a plurality of horizontal rungs spanning and cross-connecting the rails, the upper ends of rails being extended at their upper ends in bow-like fashion to enable said ends to reach at least partly over a roof or the like, a carriage carried by the rails for up and down movement, the carriage having a platform part generally normal to the plane of the ladder and a back part joined to and extending upwardly from the platform and normally lying along the rails, said back part being flexible to enable the back part to accommodate itself to the bow-like upper ends of the rails, and means for moving the carriage up and down the rails; in which, the back part comprises upper and lower portions, the lower portion being rigid with the platform and the upper part being hinged to the lower part on a horizontal axis to provide for the afore-said flexibility.

2. The combination according to claim 1, in which the moving means includes a package including a bottom adapted to rest on the ground and on which the bottom of the ladder rests, and power-operated means carried by the bottom and connected to the carriage.

3. The combination according to claim 2, in which the moving means includes a sheave at an upper part of the ladder and flexible element trained over the sheave and connected to an upper portion of the back part so as to draw the back part about the bow-like upper ends of the ladder.

* * * * *